US005373145A

United States Patent [19]

Endo et al.

[11] Patent Number: 5,373,145

[45] Date of Patent: Dec. 13, 1994

[54] COOKING APPARATUS OPERATED BY A SINGLE OPERATIONAL KEY THAT AUTOMATICALLY SETS A MOST SUITABLE COOKING MODE

[75] Inventors: Sachiko Endo; Koji Murakami; Teruya Tanaka; Kaoru Maekawa; Tatsuya Nakagawa, all of Japan

[73] Assignee: Kabushiki Kaisha Toshiba, Kawasaki, Japan

[21] Appl. No.: 77,048

[22] Filed: Jun. 16, 1993

[30] Foreign Application Priority Data

Jun. 16, 1992 [JP] Japan ..... 4-156337

[51] Int. Cl.[5] ..... H05B 6/68

[52] U.S. Cl. ..... 219/704; 219/706; 219/714; 219/723; 219/754; 219/518; 219/502; 99/325

[58] Field of Search ..... 219/10.55 B, 10.55 C, 219/10.55 D, 10.55 E, 10.55 M, 518, 502, 702, 704, 706, 714, 721, 722, 723, 738, 739, 754; 99/325

[56] References Cited

U.S. PATENT DOCUMENTS 4,517,431 5/1985 Ueda ..... 219/10.55 B
4,672,181 6/1987 Sakamoto et al. ..... 219/518
4,711,979 12/1987 Glasser et al. ..... 219/10.55 D
4,760,229 7/1988 Steers et al. ..... 219/10.55 D
4,785,152 11/1988 Hirata et al. ..... 219/10.55 B
4,868,357 9/1989 Serikawa et al. ..... 219/10.55 B

FOREIGN PATENT DOCUMENTS 04-010389 1/1992 Japan .

*Primary Examiner*—Philip H. Leung
*Attorney, Agent, or Firm*—Foley & Lardner

[57] ABSTRACT

A cooking apparatus for heating food to be served and capable of being operated with utmost simplicity without using and choosing various cooking-mode selection keys so as to achieve superb ease-of-operation. The cooking apparatus includes a cooking chamber for placing and storing food to be heated by the apparatus and a detector for detecting a state of a door attached to the cooking chamber, the door being freely openable and closable against an opening portion of the cooking chamber. An optical sensor, having a plurality of light emitting portions is disposed in a side of the cooking chamber and a plurality of light receiving portions are disposed counter to the light emitting portions. A drive unit is provided for driving the optical sensor and a judgement unit verifies and determines a cooking mode suitable for the food placed in the cooking chamber responsive to a signal from the optical sensor, where the drive unit is activated when the detector detects that the door is closed.

10 Claims, 12 Drawing Sheets

FIG.9

| COOKING MODE | | COOKING FIXTURES | POSITION | SENSOR OUTPUT |
|---|---|---|---|---|
| RANGE | WARM | ROTATION DISH 22 | 30c<br>30b<br>30a | 30c ····· ON<br>30b ····· ON-OFF<br>30a ····· OFF |
| | DEFROST | ROTATION DISH 22<br>DEFROST NET 31 | 30c<br>30b<br>30a | 30c ····· ON<br>30b ····· ON-OFF<br>30a OFF |
| OVEN | JAPANESE STYLE FOOD | ROTATION DISH 22<br>PAN 32 | 30c<br>30b<br>30a | 30c ····· ON<br>30b ····· OFF<br>30a OFF |
| | UPPER AND LOWER LEVELS | SQUARE DISH 23<br>SQUARE DISH 24 | 30c<br>30b<br>30a | 30c ····· OFF<br>30b ····· OFF<br>30a ON |
| | LOWER LEVEL | SQUARE DISH 24 | 30c<br>30b<br>30a | 30c ····· ON<br>30b ····· OFF<br>30a ON |
| GRILL | | SQUARE DISH 23 | 30c<br>30b<br>30a | 30c ····· OFF<br>30b ····· ON<br>30a ON |

FIG.13

| | COOKING MODE | COOKING FIXTURES | POSITION | SENSOR OUTPUT | WEIGHT SENSOR OUTPUT |
|---|---|---|---|---|---|
| RANGE | WAPM | ROTATION DISH | 30c<br>30b<br>30a | 30c ····OFF<br>30b ····ONorOFF<br>30a ····ONorOFF | A<X<B |
| RANGE | DEFROST | ROTATION DISH<br>DEFROST NET | 30c<br>30b<br>30a | 30c ····OFF<br>30b ····ON-OFF*<br>30a ON | — |
| RANGE | SADANESE STYLE FOOD | ROTATION DISH<br>PAN | 30c<br>30b<br>30a | 30c ····OFF<br>30b ····OFF<br>30a ON | X≧B |
| OVEN | UPPER AND LOWER LEVELS | SQUARE DISH (UPPER · LOWER) | 30c<br>30b<br>30a | 30c ····ON<br>30b ····OFF<br>30a OFF | — |
| OVEN | LOWER LEVEL | SQUARE DISH (LOWER) | 30c<br>30b<br>30a | 30c ····ON<br>30b ····OFF<br>30a ····ON | — |
| OVEN | ROUND DISH | ROUND DISH | 30c<br>30b<br>30a | 30c ····ON-OFF*<br>30b ····ON<br>30a ····ON | — |
| TOAST | | ROTATION NET | 30c<br>30b<br>30a | 30c ····OFF<br>30b ····ON<br>30a ····ON | X≦A |
| GRILL | | SQUARE DISH (UPPER) | 30c<br>30b<br>30a | 30c ····ON<br>30b ····ON<br>30a ····OFF | — |

* AT A CONSTANT PERIOD

COOKING APPARATUS OPERATED BY A SINGLE OPERATIONAL KEY THAT AUTOMATICALLY SETS A MOST SUITABLE COOKING MODE

BACKGROUND OF THE INVENTION

1. Field of the Invention

The present invention relates to a cooking apparatus in which means for detecting opening and closing of door and a light sensor are equipped.

2. Description of the Prior Art

There have been attempted various methods for simplifying operation of a cooking apparatus. Among those, the height of food is detected by means of light sensors such as light emitting and receiving elements so that the position of a heater that is freely movable in the horizontal direction is adjusted to irradiate heat most effectively. In other case where the volume of food changes with intensity of radiation heat, the heating is adjusted and controlled by detecting the height of the food.

In those conventional techniques, for example, there are provided a light emitting element and a light receiving element disposed counter to the light emitting element. The technique utilizes the cases where the light from the light emitting element permeates to reach directly to the light receiving element and where a light ray emitted from the light emitting element is interrupted by the food. The cooking apparatus executes cooking in a cooking mode selected by the user.

Accordingly, since a cooking mode of the conventional cooking apparatus is selected by the user, there are equipped a plurality of operational keys indicated such as warm key 111, defrost key 112. oven key 113 so as to choose a desired cooking mode, as shown in FIG. 1A. FIG. 1B is an overview of the conventional cooking apparatus having such provisions shown in FIG. 1A. After the user presses one of the keys and selects the cooking mode among warm. defrost, oven and grill, cooking is started for the selected cooking mode.

However, the user must operate to choose individual keys according to a desirous cooking mode for the food. For example, the user must operated separate keys such as warm key, defrost key, oven key, grill key and so on, so that the number of the operational keys are ever increasing so as to deteriorate the operability thereof.

SUMMARY OF THE INVENTION,

In view of the foregoing drawbacks, it is therefore an object of the present invention to provide a cooking apparatus capable of being operated with utmost simplicity without using and choosing cumbersome selection keys and capable of carrying out the superb ease-of-operation.

To achieve the object, there is provided a cooking apparatus comprising: a cooking chamber for placing and storing food to be heated by the apparatus; detection means for detecting a state of a door attached to the cooking chamber, the door being freely openable and closable against an opening portion of the cooking chamber; an optical sensor including a plurality of light emitting portions disposed in a side of the cooking chamber and a plurality of light receiving portions disposed counter to the light emitting portions: drive means for driving said optical sensor; and judgement means for verifying and determining a cooking mode most suitable for the food placed in the cooking chamber, responsive to a signal from said optical sensor, wherein said drive means is activated when said detection means detects that the door is closed.

By implementing the above structure, it is possible to judge what sort of cooking fixture is then placed in the cooking chamber, in accordance with the resultant detection output obtained by a plurality of optical sensors. Based on the detected output results, a cooking mode is detected so that a heating means and the like are controlled in order to proceed cooking automatically.

Accordingly, by implementing the present invention where the cooking fixtures placed on the the cooking apparatus can be correctly verified based on the outputs from the optical fibers disposed in both sides of the cooking chamber. As a result thereof, the cooking apparatus of the present invention can automatically and properly choose a cooking mode to be selected at the time the cooking starts. Thereby, there will no more need for a person to choose the proper keys among cumbersome plural keys attached in the conventional apparatus. Moreover, the present invention offers a maximally simplified cooking apparatus with superior operability ever available.

Other features and advantages of the present invention will become apparent from the following description taken in conjunction with the accompanying drawings.

BRIEF DESCRIPTION OF THE DRAWINGS

FIG. 9 is a table showing correlation between the cooking mode, cooking fixtures, position of the cooking fixture, and outputs of the optical sensors.

FIG. 13 is a table showing correlation between the cooking mode, cooking fixtures, position of the cooking fixtures, outputs of the optical sensors and outputs of the weight sensors.

DETAILED DESCRIPTION OF THE PREFERRED EMBODIMENTS

Features of the present invention will become apparent in the course of the following description of exemplary embodiments which are given for illustration of the invention and are not intended to be limiting thereof. Embodiments of the present invention will now be described with reference to the drawings.

Embodiment NO. 1

Figure 1A:
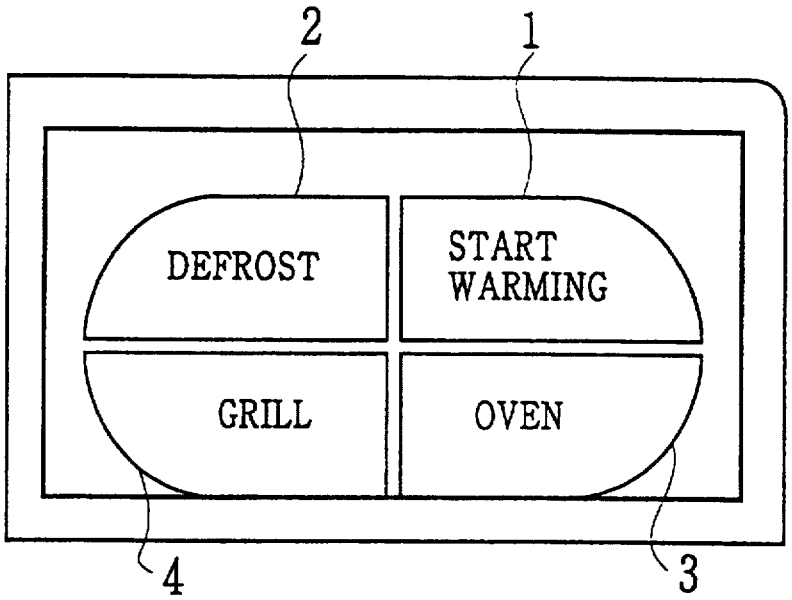
FIG.1A PRIOR ART
FIG. 1A is a portion showing operational keys in the conventional cooking apparatus.
Figure 1B:
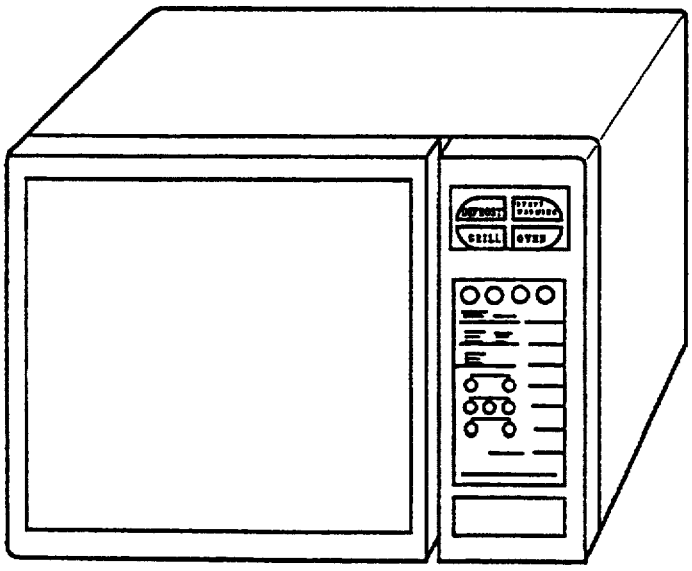
FIG.1B PRIOR ART
FIG. 1B is an overview of the conventional cooking apparatus having provision shown in FIG. 1A.
Figure 2:
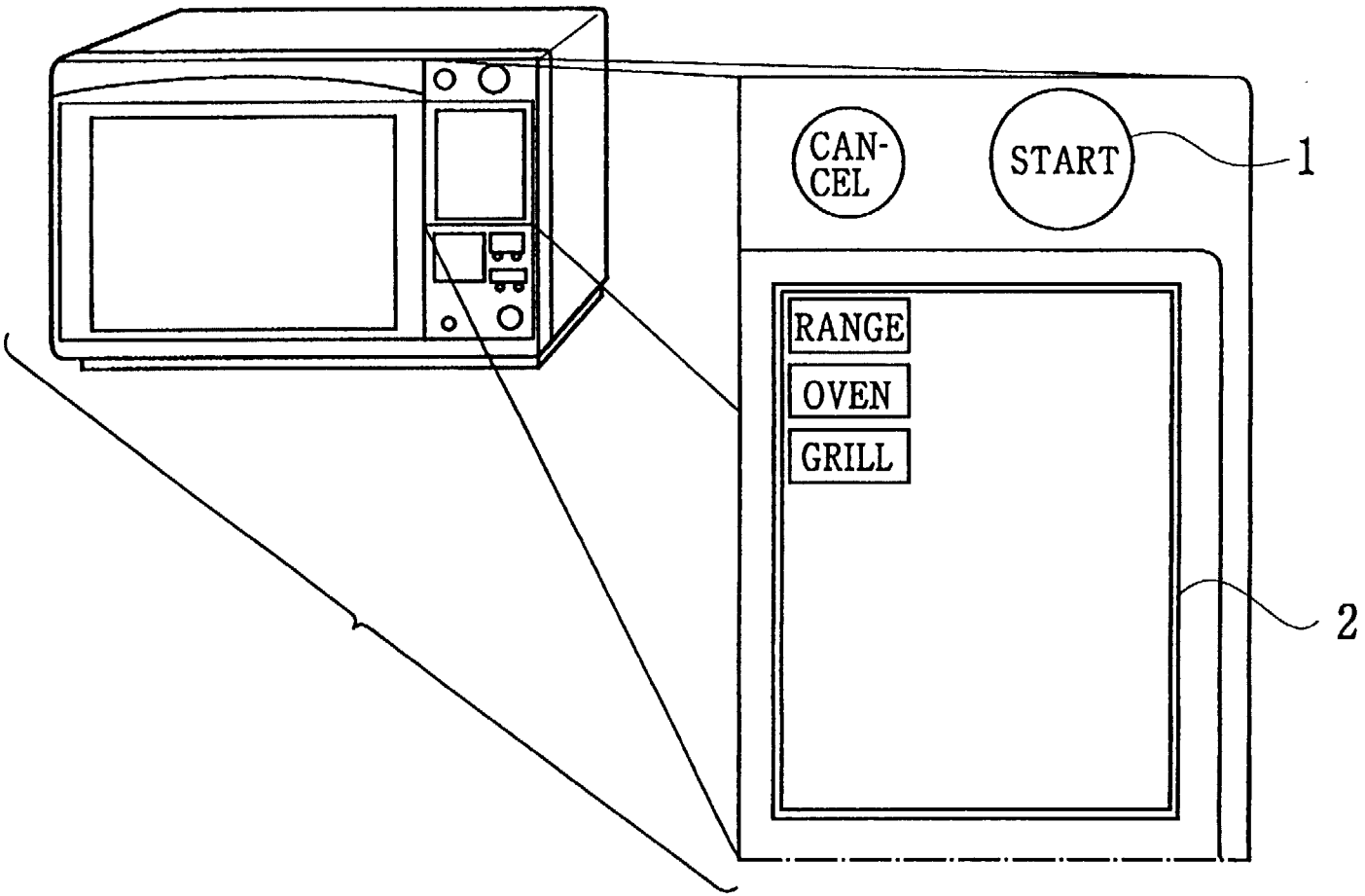
FIG. 2 shows an overview of a cooking apparatus and a display panel including an operational portion according to the present invention.

FIG. 2 is a whole view of a cooking apparatus and a display panel potion thereof including an operational portion, according to the first embodiment of the present invention.

In this embodiment and in the present invention, with reference to FIG. 2, cooking modes such as range, oven and grill are automatically determined. Thereby, it is only required to press a single start key 1. In other words, the present invention is significantly characterized in that there is no need for providing separate keys to be selected for specific cooking modes such as warm key, defrost key, oven key or grill key. Those separate cooking mode keys are simplified all the way to a single operational key, thus realizing a super simplified operability in the cooking apparatus. Conveniently, such an automatically selected cooking mode of, say, range, oven or grill (or the like) is indicated in a display panel 2 so that a user can safely confirm the automatically selected mode.

Figure 3:
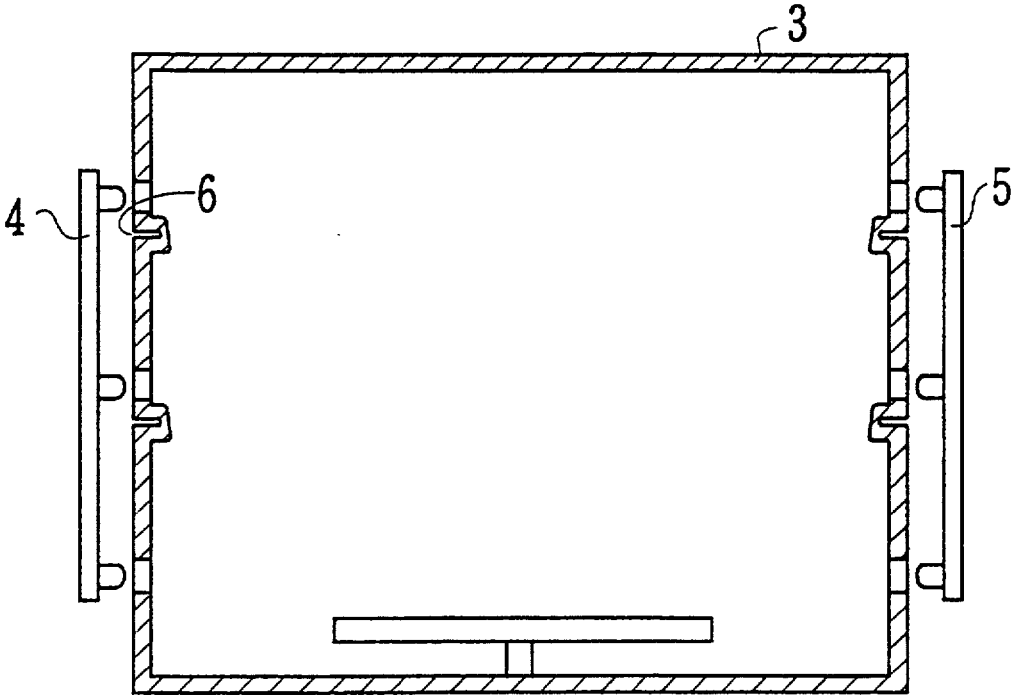
FIG. 3 is a vertical cross sectional view showing inside of the cooking apparatus shown in FIG. 1.
Figure 4:
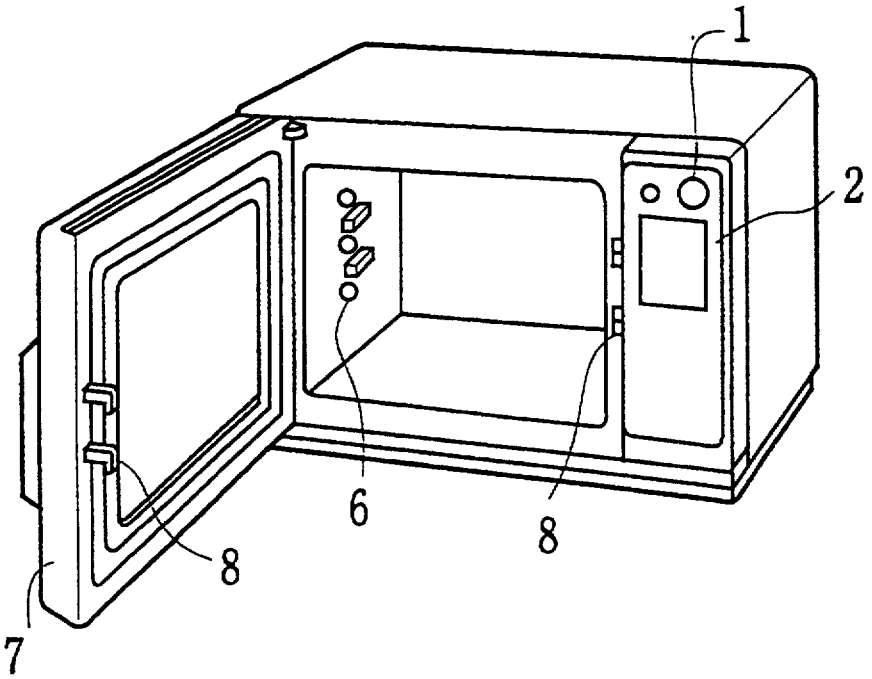
FIG. 4 is a perspective view showing an internal construction of the cooking apparatus according to the present invention.

FIG. 3 and FIG. 4 are a vertical cross sectional view and a perspective view showing an internal construction of the cooking apparatus shown in FIG. 2, respectively.

With reference to FIG. 3, there are provided a group of light emitting elements in a side portion outside of a cooking chamber 3, serving as a light emitting portion. An optical axis therefor is arranged in a substantially horizontal direction. There are provided a group of light receiving elements disposed counter to the light emitting elements and disposed in other side portion outside the cooking chamber 3. These light emitting elements 4 and the light receiving elements 5 constitute an optical sensor. There are provided opening portions along the both sides of the cooking chamber 3 so that light emitted from the light emitting elements 4 enters into the cooking chamber 3 and reaches to the .Light receiving elements through the opening portions 6. With reference to FIG. 4, opening and closing of a door 7 are detected by door open/close means 8.

Figure 5:
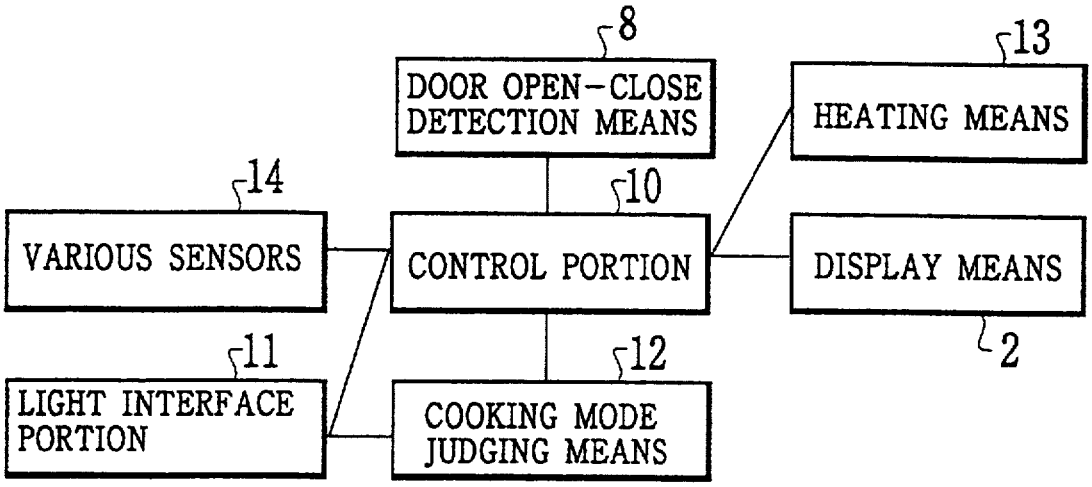
FIG. 5 is a control block diagram according to the first embodiment for the present invention.

FIG. 5 is a control block diagram according to the first embodiment.

In the same figure, a control portion 10 executes to drive the light emitting elements 4 through an optical interface portion 11. Then, the control portion 10 controls a heating means 13 based on an output of cooking mode judging means 12 which obtains a voltage output of the light emitting elements 5. In this embodiment, various sensors 14 such as a humidity sensor, a display panel 2 serving as a display means including an operational portion, and the door open/close detection means 8 which detects the opening and closing of the door 7 are connected to the control portion 10.

Figure 6A:
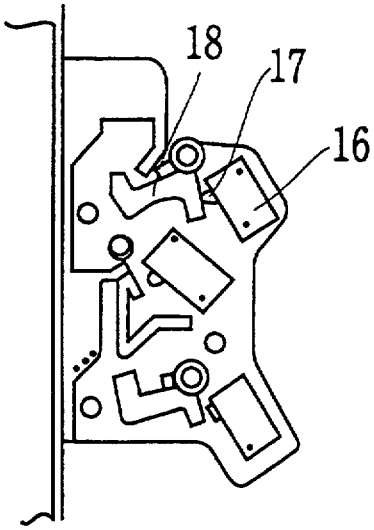
FIG. 6A and FIG. 6B are sketch drawings showing major parts for door open/close means.
Figure 6B:
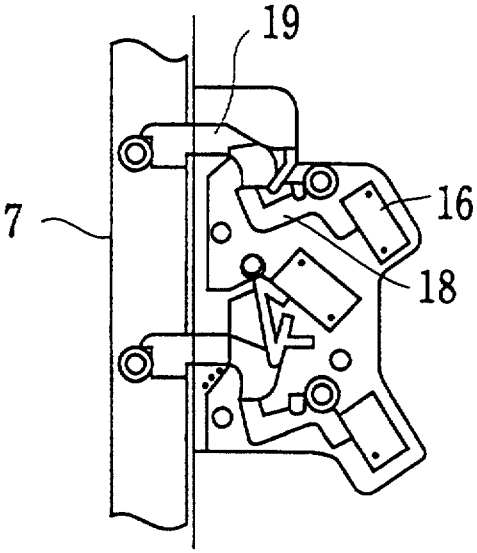

FIG. 6A and FIG. 6B are general views showing major parts for door open/close means 8. FIG. 6A shows a state of door being opened while FIG. 6B door being closed. In the same figures, there is provided a switch 16 having a protruding portion 17 by which the switch 16 becomes ON or OFF responsive to the state of the protruding portion 17 being depressed or not. There is provided a member 18 rotatably arranged in the vicinity of a contact point of the protruding portion 17 so that when the door is being open, no force from the member 18 acts on the contact point 16 of the switch 16, whereas, when the door is closed, a projected portion 19 presses the member 18 downward so as to cause the member 18 to rotate and press the contact point of the switch 16.

Figure 7:
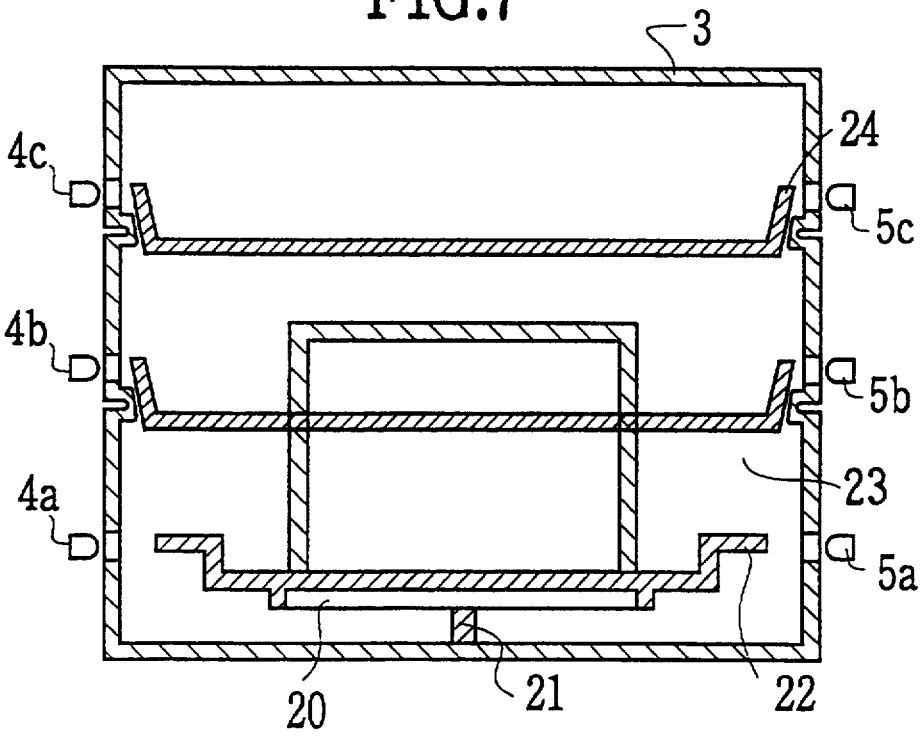
FIG. 7 is a vertical cross sectional view showing an internal construction of the cooking apparatus where there are provided three pairs of the light emitting elements and the light receiving elements serving as sensors.

FIG. 7 is a vertical cross section view showing an internal construction of the cooking apparatus where there are provided three pairs of the light emitting elements and the light receiving elements serving as sensors.

In the same figure, there is provided a rotation plate 20. The rotation plate 20 is such that the rotation plate 20 is connected to a rotation axis 21 which is driven by a motor (not shown) that is located outside a base of the cooking chamber 3, in an opening part provided in a center of the plate 20. There are provided a pair of light emitting and receiving elements 4*a*, 5*a* disposed in sides outside the cooking chambers in a lower level thereof for detecting a rotation plate 22 which is a cooking fixture and is disposed on the rotation dish 20. Moreover, a square plate (lower level) 23 as other cooking fixture is supported by a projected member provided in an approximately center of the cooking chamber 3 so as to keep a predetermined height from the base of the cooking chamber 3. There are provided a pall of light emitting and receiving elements 4*b*, 5*b* for detecting the square plate (lower level) 23 in an approximate center of the cooking chamber 3. Further, there is provided a square plate (upper level) 24 as still other cooking fixture is supported by a projected member provided in an upper level side of the cooking chamber 3 so as to keep a predetermined upper height from the base of the cooking chamber and the lower square plate 23. There are provided a pair of light emitting and receiving elements 4*c*, 5*c* for detecting the upper square plate 24 in both sides of approximately upper level and outside of the cooking chamber 3. The square plates 23, 24 and the rotation plate 22 may be substituted and placed by a user according to a specific cooking mode.

Figure 8A:
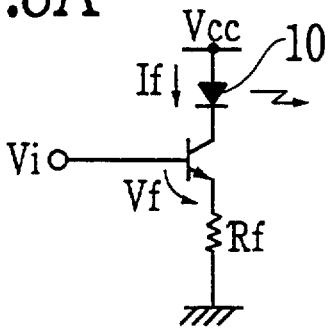
FIGS. 8A through 8C are circuit diagrams of an interface portion in the light emitting and receiving elements.
Figure 8C:
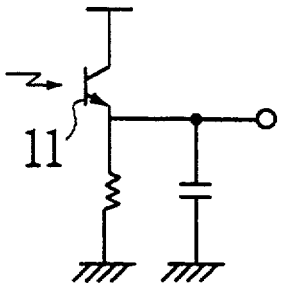
Figure 8B:
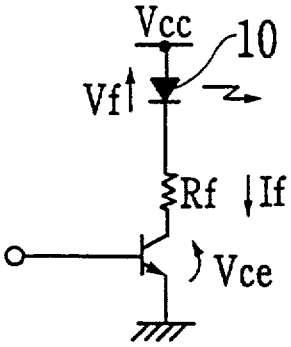

FIGS. 8A through 8C are circuit diagrams of the interface portion in the light emitting and receiving elements 4, 5. FIG. 8A and FIG. 8B are drive circuits for the light emitting elements 4. FIG. 8C is a voltage output circuit for the light receiving elements 5. In FIG. 8A, an input current If flowing through the light emitting elements 4 is expressed by the following equation:

$$IF=(Vi-Vf)/Rf$$

In FIG. 8B, the input current If is expressed by $$If=(Vcc-Vf-Vce)/Rf$$

In other words, the output of the sensor functions such that it becomes ON when the light of the light emitting elements 4 reach the light receiving elements 5, whereas it becomes OFF when the light of the light emitting elements 4 does not permeate and reach the light receiving elements 5 (i.e. the light is shut off).

FIG. 9 is a table showing correlation between the cooking mode, cooking fixtures, position of the cooking fixtures, and outputs of the optical sensors.

In the same figure, the cooking mode judgement for such as defrost, warm, oven, range and the like is reliably executed based on the outputs from optical sensors 30*a*, 30*b*, 30*c* which correspond to the light emitting elements 4*a*, 4*b*, 4*c* and the light receiving elements 5*a*, 5*b*, 5*c*, respectively.

Figure 10:
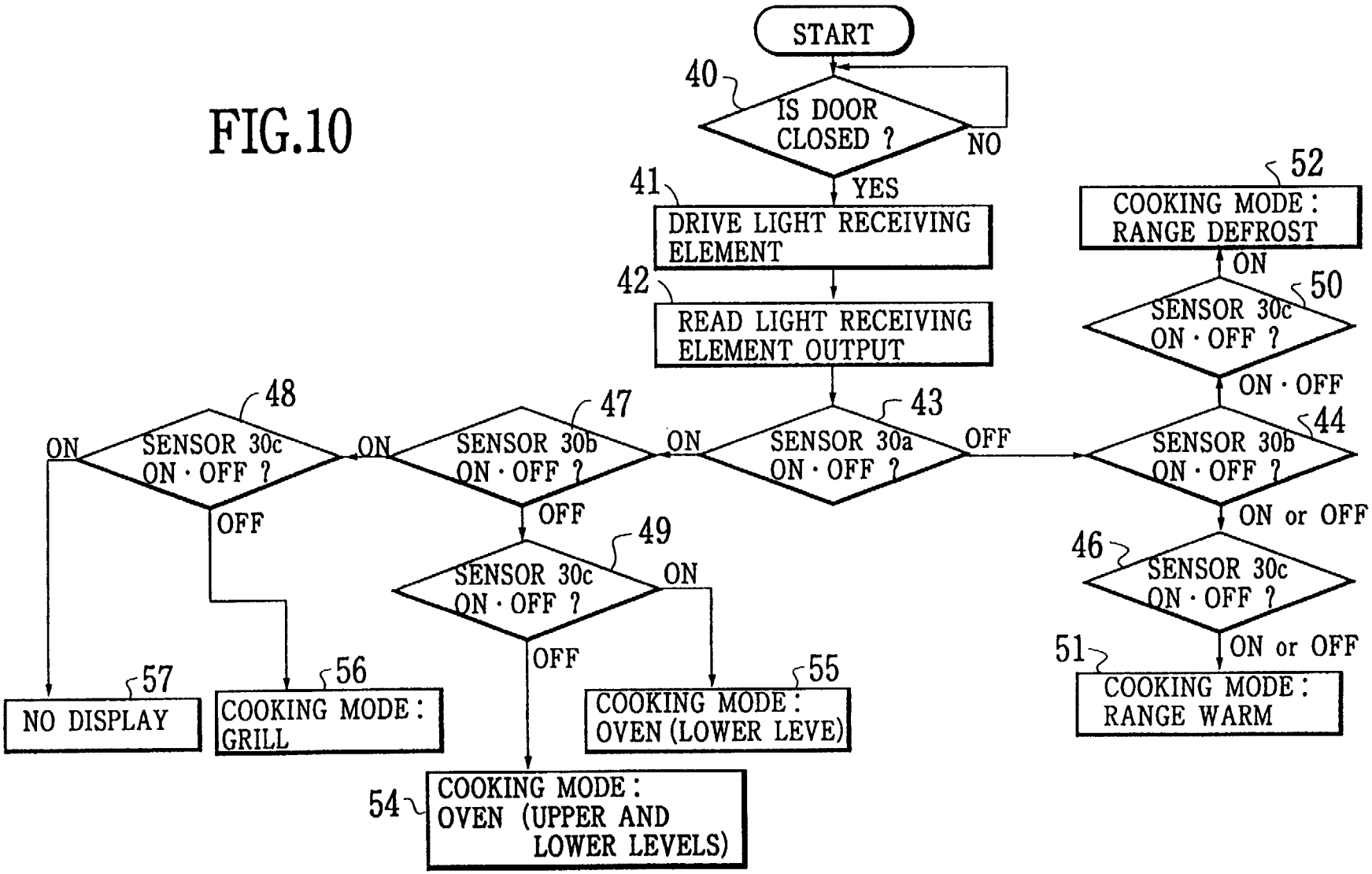
FIG. 10 is a control flowchart for the first embodiment.

With reference to a flowchart shown in FIG. 10, a proceeding of the operation for the cooking apparatus thus configured will be described in detail.

First, the power supply is applied to the cooking apparatus, then the user places food or a thing to be heated, into the cooking chamber 3 and the door 7 is closed. Opening and closing of door 7 are detected by the door open/close detection means 8 (STEP 40). If door 7 is closed, the light emitting elements 4 (4*a*, 4*b*, 4*c*) are driven and the outputs of light receiving elements 5 (5*a*, 5*b*, 5*c*) are read (STEP 41 and STEP 42). Thereafter, detected are outputs of sensors 30*a*, 30*b*, 30*c* comprising the light emitting elements 4 and the light receiving elements 5 (STEP 43, STEP 44, STEP 45, STEP 46, STEP 47, STEP 48, STEP 49 and STEP 50).

When the outputs of the sensor are such that 30*a* is OFF, and 30*b* and 30*c* are ON or OFF (STEP 43, STEP 44 and STEP 46), the rotation plate as the cooking fixture is judged to be placed so that the cooking mode is judged as the warm mode of the range and then the display panel 2 is indicated accordingly (STEP 51).

When the outputs of the sensor are such that 30*a* is OFF, 30*b* is ON or OFF, and 30*c* is ON (STEP 43, STEP 44 and STEP 50), the rotation plate 22 and defrost net 31 are judged to be placed as the cooking fixtures so that the cooking mode is judged as defrost mode of the range and then the display panel 2 is indicated accordingly (STEP 52). Then, a reason why the output of sensor 30*b* indicates ON or OFF is due to a shape of legs attached to the defrost net 31 placed oil the rotation plate 22 which is rotated together with the rotation plate 20.

When the outputs of the sensor are such that 80*a* is ON, 30*b* is OFF and 30*c* is OFF (STEP 43, STEP 47 and STEP 49), the square plate (upper level) 23 and the square plate (lower level) 24 are judged to be placed so that the cooking mode of the oven is judged to be both the upper and lower level for the oven and then the display panel 2 is indicated accordingly (STEP 54).

When the outputs of the sensor are such that 30*a* is ON, 30*b* is OFF and 30*c* is ON, the square plate (lower level) 23 is judged to be placed as the cooking fixture, so that the cooking mode is judged as the lower level mode of the oven, and then the display panel 2 is indicated accordingly (STEP 55).

When the outputs of the sensor are such that 30*a* is ON, 30*b* is ON and 30*c* is OFF (STEP 43, STEP 47 and STEP 48), the square plate (upper level) 24 is judged to be placed as the cooking fixture, so that the cooking mode is judged as the upper level mode for grill and then the display panel 2 is indicated accordingly (STEP 56).

When the outputs of the sensor are such that all of 30*a*, 30*b* and 30*c* are ON (STEP 43, STEP 47 and STEP 48), it is judged that there is nothing placed inside the cooking chamber 3, so that no indication appears in the display panel 2 (STEP 57).

Then, a judgement procedure for the cooking mode is ended. Thereafter, the heating means 13 is controlled in accordance with a result of the cooking mode judging procedure so as to execute a most suitable cooking.

In the cooking apparatus and the cooking method therefor, the user need not press any buttons to choose an appropriate cooking mode. All what the user needs to do for cooking is to depress a single start key after the food is placed on a plate and the door is closed, so that a predetermined cooking automatically started and terminated. Thereby, the present invention offers the cooking apparatus with the utmost simplified operational capability and superb cooking capability.

Embodiment NO. 2

Figure 11:
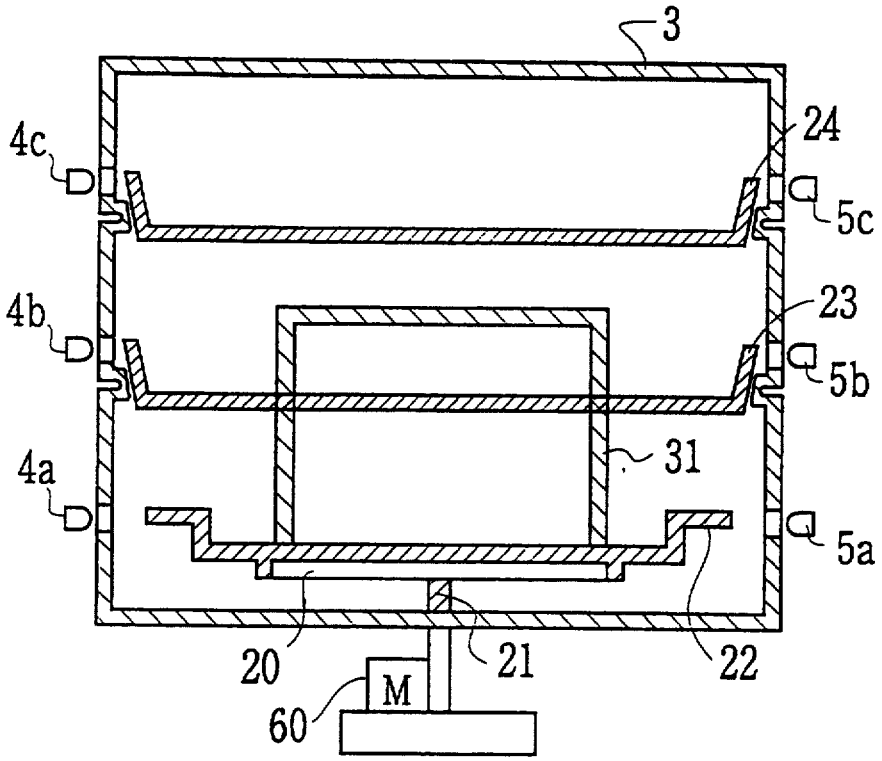
FIG. 11 is a vertical cross sectional view showing internal construction of the cooking apparatus according to the second embodiment.

With reference to FIG. 11, there is shown a vertical cross sectional view showing internal construction of the cooking apparatus according to the second embodiment.

With reference to FIG. 11, there are provided a group of light emitting elements in a side portion outside of the cooking chamber 3, serving as a light emitting portion. An optical axis therefor is arranged in a substantially horizontal direction. There are provided a group of light receiving elements 5 disposed counter to the light emitting elements 4 and disposed in other side portion outside the cooking chamber 3. These light emitting elements 4 and the light receiving elements 5 constitute an optical sensor. There are provided opening portions along both sides of the cooking chamber 3 so that light emitted from the light emitting elements 4 enters into the cooking chamber 3 and reaches to the Light receiving elements through the opening portions 6.

In the same figure, there is provided a rotation plate 20. The rotation plate 20 is constructed in a manner that the rotation plate 20 is attached to an rotation axis 21 which is driven by a motor 60 that is located outside a base of the cooking chamber 3. An rotation axis 21 is protruded upward from the base of the cooking chamber 3. There are provided a pair of light emitting and receiving elements 4*a*, 5*a* disposed in sides outside the cooking chambers in a lower level thereof for detecting a rotation dish 22 which is a cooking fixture and is disposed on the rotation plate. Moreover, a square dish (lower level) 23 as other cooking fixture is supported by a projected member provided in an approximate center of the cooking chamber 3 so as to keep a predetermined height from the base of the cooking chamber 3. Moreover, there is provided a square dish (upper level) 24 as still other cooking fixture is supported by a projected member provided in an upper level side of the cooking chamber 3 so as to keep a predetermined upper height from the base of the cooking chamber and the lower square plate 23. There are provided a pair of light emitting and receiving elements 4*c*, 5*c* for detecting the upper square dish 24 in both approximately upper side level and outside of the cooking chamber 3. Now the second embodiment is characterized by that there is provided a weight sensor 61 that is disposed below the cooking chamber 3 and that measures the weight of food placed on the rotation dish 22.

Figure 12:
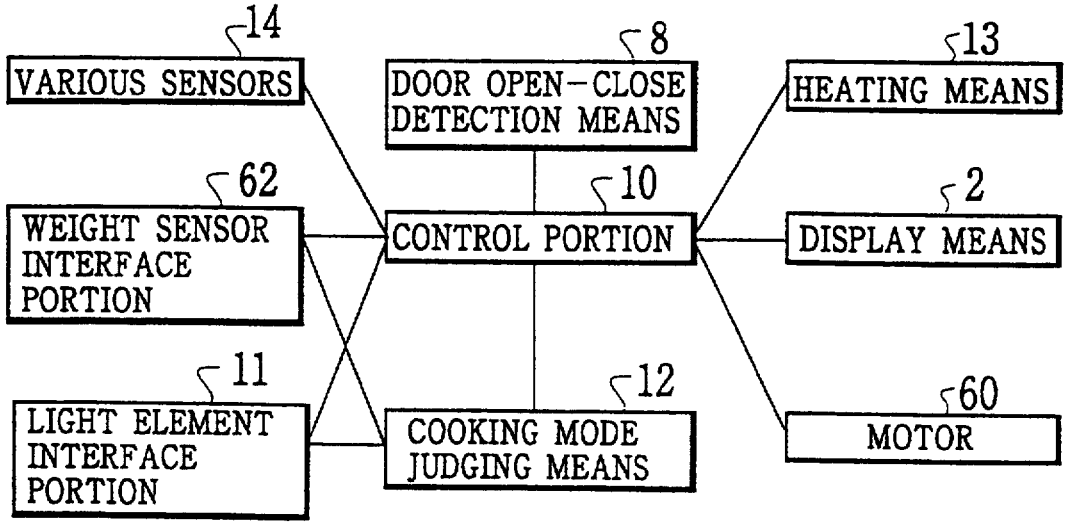
FIG. 12 is a block diagram for controlling the cooking apparatus shown in FIG. 11.

FIG. 12 is a block diagram for controlling the cooking apparatus. according to the second embodiment.

With reference to FIG. 12, a control portion 10 drives the group of the light emitting elements through the light element interface portion, and the control portion 10 controls heating means 13 in accordance with an output of cooking mode judging means 12 based on a voltage output of the group of the light receiving output and a detected result of the the weight sensor. In this second embodiment, various sensors 14 such as a humidity sensor 14, a display panel 2 serving as a display means including an operational portion and such as the opening and closing of the door 7 are connected to the control portion 10.

FIG. 13 is a table showing correlation between the cooking mode, cooking fixtures, position of the the cooking fixtures, outputs of the optical sensors and outputs of the weight sensors.

Accordingly, there can be made possible to execute safely a judgement for determining the cooking modes among defrost, warm, oven, range and so on based on the outputs of optical sensors 30*a*, 30*b*, 30*c* (light emitting elements 4*a*, 4*b*, 4*c* and light receiving elements 5*a*, 5*b*, 5*c*) and the outputs of weight sensors 61.

Figure 14:
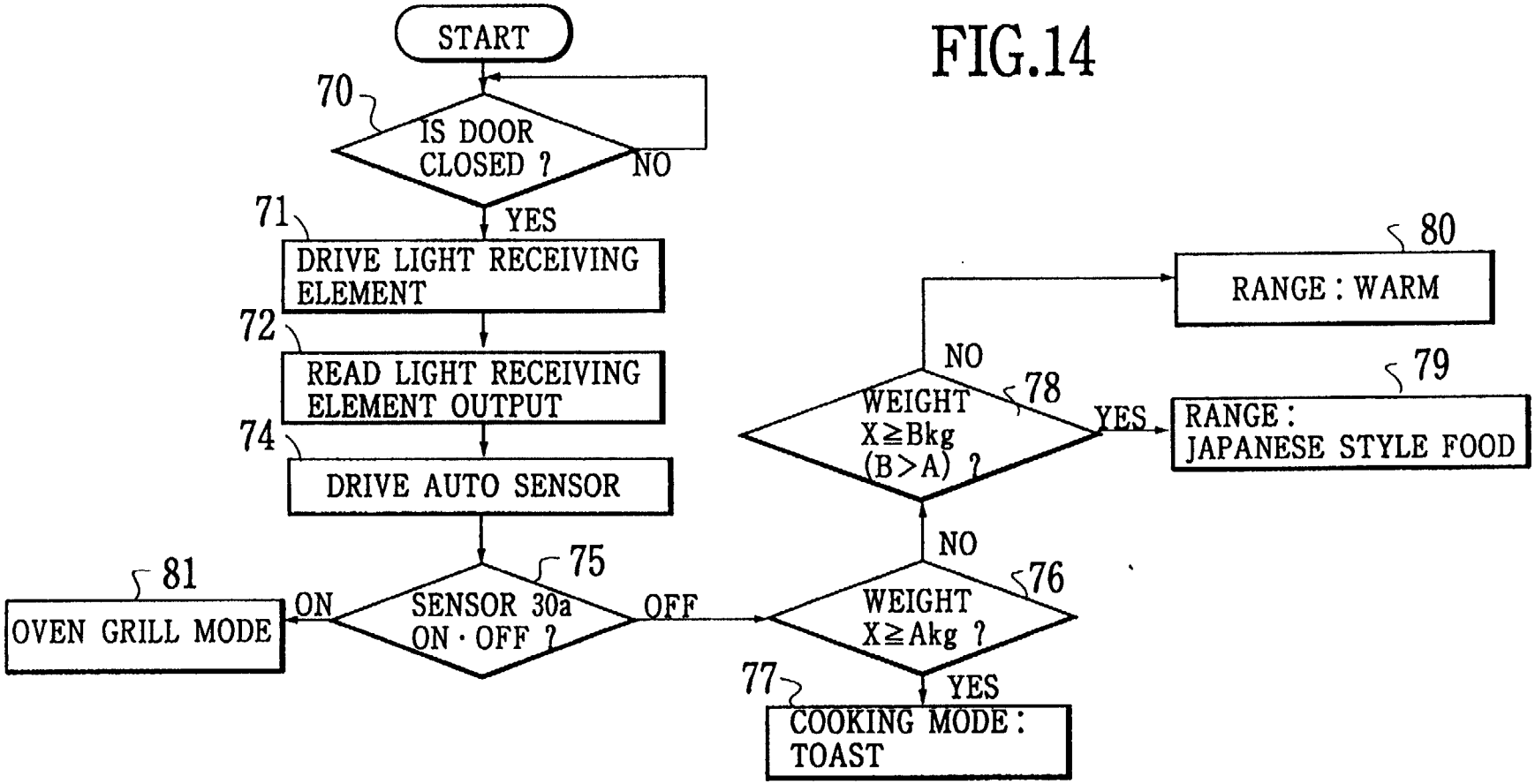
FIG. 14. is control flowchart for the second embodiment.

Next, with reference to a flowchart shown in FIG. 14, a proceeding of the operation for the cooking apparatus thus configured in the second embodiment will be described in detail.

First, the power supply is applied to the cooking apparatus, then the user places food or a thing to be heated, into the cooking chamber 3 and the door 7 is closed. Opening and closing of door 7 are detected by the door open/close detection means 8 (STEP 70). If the door 7 is confirmed to be closed, the group of light emitting elements 4 (4*a*, 4*b*, 4*c*) are driven and the outputs of the group of light receiving elements 5 (5*a*, 5*b*, 5*c*) are read (STEP 71 and STEP 72). Then, the weight sensor 61 is driven (STEP 74).

Thereafter, detected are the outputs of the sensors 30*a*, 30*b*, 30*c* composed of the group of light emitting elements 4 and light receiving elements 4.

When the output of the sensor indicates that 30*a* is OFF (STEP 75), the output of the weight sensor 61 is detected (STEP 76). Then, the detected weight X is less than A kg, the cooking mode is judged to be for toast, so that the display panel 2 is indicated as such (STEP 77).

Moreover, in a case where the detected weight output X is greater than A kg, detected is whether X is greater than B kg or not (STEP 78). If the detected output X is greater than B kg, the cooking mode is judged to be Japanese style and then the display panel 2 is indicated as such (STEP 80).

When the output of the sensor indicates that 30*a* is ON (STEP 75), a similar procedure described in the first embodiment shall be taken (STEP 81).

Then, a judging procedure for the cooking mode is ended. Thereafter, the heating means 13 is controlled in accordance with a result of the cooking mode judging procedure so as to execute a suitable cooking.

In the cooking apparatus and the cooking method described in the second embodiment, the user need not depress various cumbersome buttons to choose an appropriate cooking mode which he or she desires. All what is needed is to depress the single start key 1 after the food is placed on a plate therein and the door is closed, so that a proper cooking is automatically carried out. Thereby, in addition to the first embodiment, it is possible to automatically judge modes such as toast, Japanese style, range and so on, thus realizing further improved automatic cooking.

Embodiment No. 3

Next, there is shown some variations for the previously described embodiments.

With reference to FIG. 13, there is shown a table correlation between the cooking mode, cooking fixtures, position of the cooking fixtures, outputs of the optical sensors and outputs of the weight sensors.

As shown in FIG. 13, by utilizing the outputs of the light sensors 30*a*, 30*b*, 30*c* (light emitting elements 4*a*, 4*b*, 4*c* and light receiving elements 5*a*, 5*b*, 5*c*) and the outputs of the weight sensors 61, the cooking judgement for defrost, warm, oven, range and so on is accurately and safely executed. In the third embodiment, it is characterized that the cooking fixtures such as a defrost net 31 (for defrosting a freshly frozen food) and round-shape dish usually used for an oven are further easily verified and detected.

In other words, by rotating the rotation plate 20 for a predetermined duration of time, whether there is food placed, the legs of the defrost net 31 or a joint portion of a tray surface of the round-shape dish and a receiving portion thereof is verified by detecting an ON-OFF frequency of the light sensors 30*a*, 30*b*, 30*c* so that legs of the dishes and food are further correctly verified.

Figure 15:
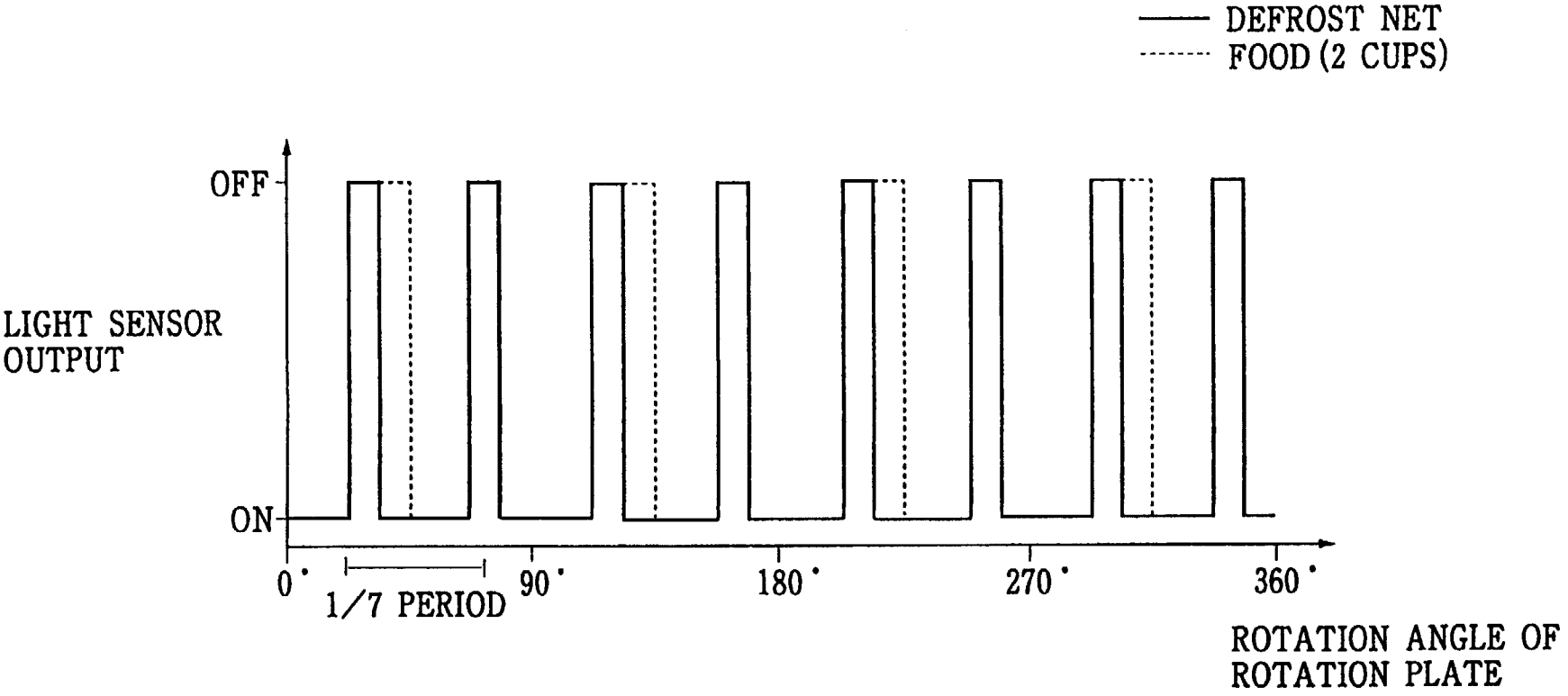
FIG. 15. is a graph showing a characteristic of the output of the optical sensors in a case where there is used a defrost net according to the third embodiment.

With reference to FIG. 15, there is shown a graph indicating a characteristic of the output of the light sensors against the rotation period thereof in a case where there is used the defrost net 31. Under such a condition shown in FIG. 15, the defrost net 31 having eight legs positioned equi-distantly is placed on the rotation plate 20, and the graph shown in FIG. 15 indicates a result when this rotation plate 20 rotates fully once (360 degrees).

In the same figure, the rotation plate 20 is rotated with 1/7 period and an OFF duration of the light sensor is detected, so that the number of items (food) can be verified. In this case there are two cups or glasses.

Figure 16:
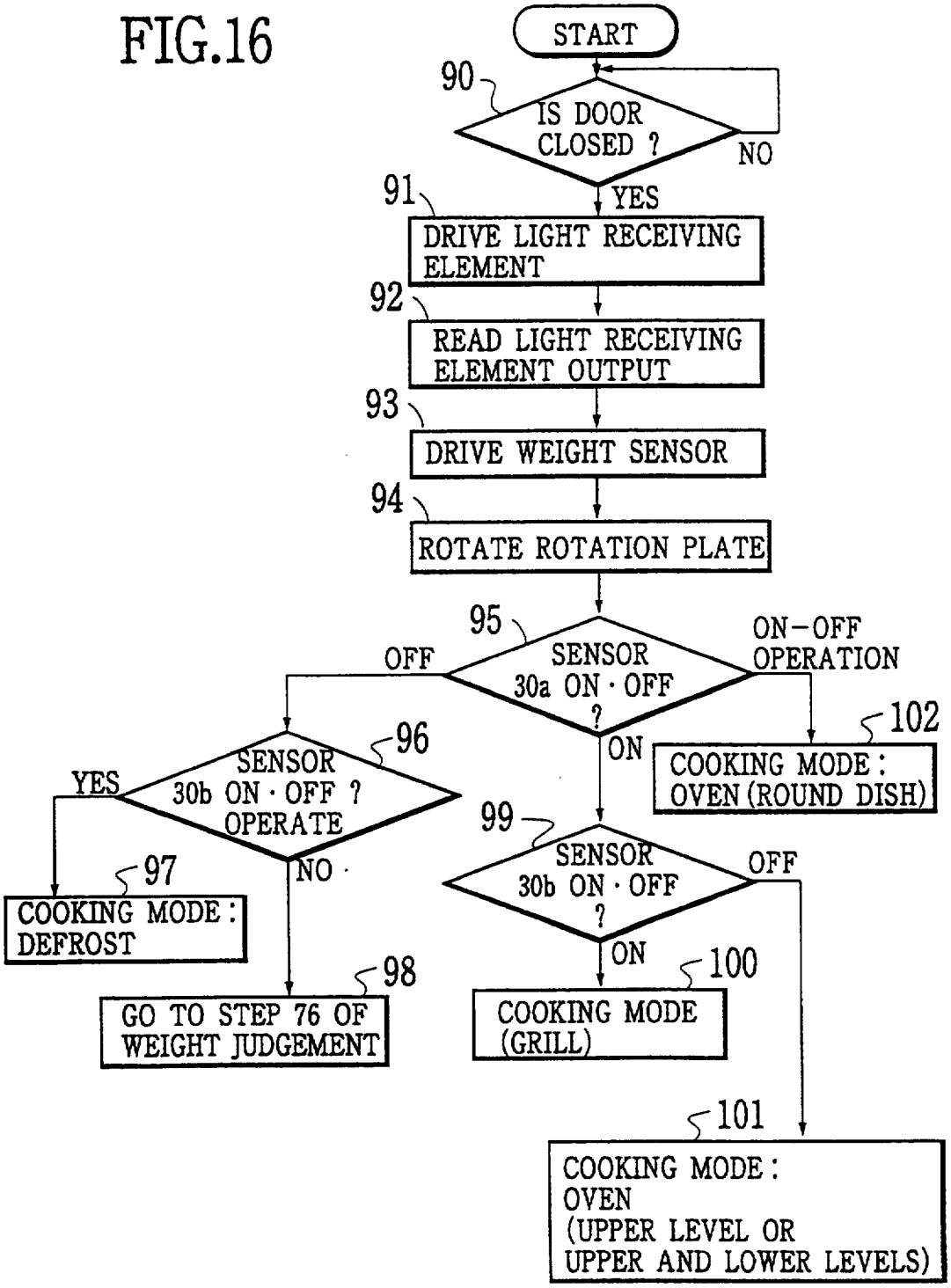
FIG. 16 is a control flowchart for realizing the third embodiment.

Next, with reference to a flowchart in FIG. 16, there will be described an operation of the cooking apparatus according to the third embodiment.

First, the power supply is applied to the cooking apparatus, then the user places food or an item to be heated, into the cooking chamber 3 and the door 7 is closed. Opening and closing of door 7 are detected by the door open/close detection means 8 (STEP 90). If the door 7 is confirmed closed, the group of the light emitting elements 4 (4*a*, 4*b*, 4*c*) are driven and the outputs of the group of light receiving elements (5*a*, 5*b*, 5*c*) are read (STEP 91 and STEP 92).

Thereafter, the weight sensor 61 is driven (STEP 93) and the rotation plate 20 is rotated for a predetermined period of time by means of motor 60 (STEP 94).

Thereafter, detected are the outputs of the group of light emitting elements 4 and the group of the light receiving elements.

If the output of the sensor indicates that 30*a* is OFF (STEP 95), proceed to detect the output of the sensor 30*b* (STEP 96). If the output of the sensor indicates that 30*b* is ON or OFF, the cooking mode is judged to be the freshly frozen food defrost, then the indication panel 2 is indicated as such (STEP 97). If the output of 30*b* is not ON or OFF, proceed to step 76 for verifying the weight thereof (STEP 98).

If the output of the sensor indicates that 30*a* is ON (STEP 95), proceed to detect the output of the sensor 30*b* (STEP 99). If the output of the sensor indicates that 30*b* is ON, the cooking mode is judged to be the grill mode, and then the indication panel 2 is indicated as such (STEP 100). Moreover, if the output of 30*b* is OFF, the cooking mode is judged to be the oven mode (upper level or upper and lower level), and then the indication panel is indicated accordingly (STEP 101), If the output of tile sensor indicates that 30*a* is ON or OFF operated, the cooking mode is judged to be in a round-shape dish use, and then the indication panel 2 is indicated as such (STEP 102), Then, a judgement procedure for verifying the cooking mode is terminated. Thereafter, the heating means 13 is controlled in accordance with a result of the above cooking mode judging procedure so as to execute a desired cooking.

In other words, the user the user need not operate any various function keys. Instead, the user only need depress the single start key after the food is placed on a plate in the cooking chamber and the door is closed, so that a desired cooking is executed automatically. Thereby, an operational portion for the cooking apparatus is significantly simplified and a superb cooking capability thereby is achieved, Moreover, in the third embodiment where the rotation plate 20 is rotated so as to detect the outputs of the light sensor, it becomes possible to verify even a defrosting state for the Freshly frozen food and a use of the round-shape dish, thus realizing further superior automatic cooking.

Moreover, after the cooking mode is verified, detection of food height utilizing the light sensors 30*a*, 30*b*, 30*c* makes possible further advanced automatic cooking, if there is required a menu verification.

Moreover, after the cooking mode is verified and indicated in the indication panel 2, the start key may be arranged to flicker for warning if the user forgets to press the start key.

In summary, by implementing the present invention, a plurality of light sensing sensors disposed in the side of the cooking apparatus verify the food, placed in the cooking chamber, for automatic cooking thereof. Therefore, there is no need for the use to select and press an operational key among various function keys in order to choose a cooking mode and so on. Thereby, significant simplification of the operational portion is achieved. At the same time, there is realized a cooking apparatus with superiority in operational capability thereof.

Besides those already mentioned above, many modifications and variations of the above embodiments may be made without departing from the novel and advantageous features of the present invention. Accordingly, all such modifications and variations are intended to be included within the scope of the appended claims.

What is claimed is :

1. A cooking apparatus comprising:

a cooking chamber for placing and storing food to be heated by the apparatus;

detection means for detecting a state of a door attached to the cooking chamber and providing a detection signal indicative thereof, the door being freely openable and closable against an opening portion of the cooking chamber;

an optical sensor including a plurality of light emitting portions disposed in a side of the cooking chamber and a plurality of light receiving portions disposed counter to the light emitting portions, said optical sensor generating a signal indicative of light received by said light receiving portions;

drive means for driving said optical sensor in accordance with the signal received from said detection means;

a single operational key providing an operational signal when activated: and judgement means, responsive to the signal from said optical sensor and the operational signal from said single operational key, for verifying and determining a cooking mode suitable for the food placed in said cooking chamber, wherein said drive means is activated when said detection means detects that the door is closed and wherein a proper cooking mode is automatically selected by activation of said single operational key.

2. The cooking apparatus as recited in claim 1, further comprising:

means for rotating the food and generating a rotation signal indicative thereof; and means for sensing the weight of the food and producing a weight signal indicative thereof; and rotation control means for controlling the rotating means in accordance with said rotation signal and said weight signal, said rotating means being rotated for a predetermined period of time and being permitted to rotate only when the door is confirmed to be closed by said detection means.

3. A cooking apparatus comprising:

a cooking chamber for placing and storing food to be heated by the apparatus;

detection means for detecting a state of a door attached to the cooking chamber and providing a detection signal indicative there of, the door being freely openable and closable against an opening portion of the cooking chamber;

optical sensor including a plurality of light emitting portions disposed in a side of the cooking chamber and a plurality of light receiving portions disposed counter to the light emitting portions;

means for sensing the weight of the food;

drive means for driving said optical sensor and said weight sensing means in accordance with the signal from the detection means; and judgement means for verifying and determining a cooking mode suitable for the food placed in said cooking chamber, responsive to a signal from said optical sensor and the weight sensing means, wherein said drive means is activated when said detection means detects that the door is closed and wherein a proper cooking mode is automatically selected by activation of a single operational key.

4. The cooking apparatus as recited in claim 3 further comprising:

means for rotating the food; and rotation control means for controlling the rotating means in accordance with a signal from the weight sensing means, said rotating means being rotated for a predetermined period of time and being permitted to rotate only when the door is confirmed to be closed by said detection means.

5. A method for cooking food placed in a cooking chamber of a cooking apparatus, the method comprising the steps of:

applying a power supply to tile cooking apparatus;

placing the food into a cooking chamber inside the cooking apparatus;

closing a door of the cooking apparatus;

detecting the opening and the closing of the door;

activating a plurality of light emitting elements disposed at a side of the cooking apparatus only when the door is detected to be closed;

reading outputs of light receiving elements responsive to the light emitting elements;

determining automatically a suitable cooking mode in accordance with data obtained from the outputs of the light receiving elements;

depressing a single operational key of the cooking apparatus to start the heating of the food;

controlling a heating mechanism to achieve the suitable cooking.

6. The method of claim 5 equipped with a motor to rotate a cooking plate, further comprising the step of:

sensing the weight of the food; and rotating the cooking plate for a specific duration of time.

7. A cooking apparatus comprising:

a cooking chamber receiving food to be heated by the apparatus;

means for rotating the food and generating a rotation signal indicative thereof;

an optical sensor including a plurality of light emitting portions disposed in a side of the cooking chamber and a plurality of light receiving portions disposed in a light path of the light emitting portions, said optical sensor producing signals indicative of when light is received by the light receiving portions; and judgement means, receiving the signals from said optical sensor, for verifying and determining a cooking mode suitable for the food in said cooking chamber according to an ON/OFF light frequency detected by the plurality of light receiving portions.

8. The cooking apparatus as recited in claim 7 further comprising:

detection means for detecting a state of a door attached to the cooking chamber and providing a detection signal indicative thereof, the door being freely openable and closable against an opening portion of the cooking chamber;

drive means for driving said optical sensor in accordance with the signal received from said detection means;

a single operational key providing an operational signal to the judgment means when activated, said judgment means being responsive to the operational signal from said single operational key, for verifying and determining a cooking mode suitable for the food in said cooking chamber.

9. The cooking apparatus as recited in claim 8, further comprising:

means for sensing the weight of the food and producing a weight signal indicative thereof; and rotation control means for controlling the rotating means in accordance with said rotation signal and said weight signal, said rotating means being rotated for a predetermined period of time and being permitted to rotate only when the door is confirmed to be closed by said detection means.

10. The cooking apparatus as recited in claim 7, wherein the judgment means utilizes said ON/OFF light frequency to determine a number of food items placed in said cooking chamber.

* * * * *